US005666742A

United States Patent [19]

Greve et al.

[11] Patent Number: 5,666,742

[45] Date of Patent: Sep. 16, 1997

[54] TEMPERATURE MODIFICATION ASSEMBLIES

[75] Inventors: Christopher G. Greve, Covington; Ronald M. O'Connor, Jefferson, both of La.

[73] Assignee: The Laitram Corporation, Harahan, La.

[21] Appl. No.: 164,949

[22] Filed: Dec. 10, 1993

[51] Int. Cl.[6] ..... F26B 19/00

[52] U.S. Cl. ..... 34/218; 34/90; 34/219

[58] Field of Search ..... 34/218, 219, 104, 34/96, 97, 98, 90, 91, 191

[56] References Cited

U.S. PATENT DOCUMENTS

| | | | |
|---|---|---|---|
| 1,743,660 | 1/1930 | Edwards | 34/219 |
| 2,293,316 | 8/1942 | Stebbins | 34/196 |
| 2,439,487 | 4/1948 | Reilly | 34/191 X |
| 2,618,864 | 11/1952 | O'Neil | 34/90 X |
| 2,831,267 | 4/1958 | Gardner | 34/219 |
| 3,154,392 | 10/1964 | Littman | 34/104 |
| 4,787,153 | 11/1988 | Chen | 34/104 |
| 4,961,271 | 10/1990 | Butler | 34/218 |
| 5,058,289 | 10/1991 | Guindon | 34/104 |
| 5,072,640 | 12/1991 | Greve et al. . | |

FOREIGN PATENT DOCUMENTS

| | | | |
|---|---|---|---|
| 1588342 | 4/1970 | France | 34/622 |

*Primary Examiner*—Henry A. Bennett
*Assistant Examiner*—Dinnata Doster
*Attorney, Agent, or Firm*—Leydig, Voit & Mayer

[57] ABSTRACT

A temperature modification assembly comprises a housing, a temperature modification element disposed in the housing, and a blower arranged to direct an air flow past the temperature modification element. The temperature modification assembly may further comprise at least one freely extending duct coupled to the housing, communicating with the blower and defining a pocket having a narrow profile; first and second freely extending ducts coupled to the housing and a blower arranged to direct a flow of air between the first and second ducts; and/or an open ended jacket cooperatively arranged with the housing and a blower arranged to circulate a flow of air between the temperature modification element and the interior of the jacket.

29 Claims, 4 Drawing Sheets

TEMPERATURE MODIFICATION ASSEMBLIES

FIELD OF THE INVENTION

This invention relates to assemblies for modifying the temperature of many different types of items, including items stored in a container.

BACKGROUND OF THE INVENTION

In many environments, especially industrial environments, modifying the temperature of various items, i.e., heating or cooling them, is frequently desirable. For example, modular plastic conveyor belts are typically formed by linking many elongate plastic modules, and these modules often need to be cut to size for various applications, as disclosed in U. S. Pat. No. 5,072,640. When the plastic modules are heated, they are easier to cut. In particular, heating the plastic modules allows them to be cut quickly without shattering and with little damage to the cutting blade.

Large, walk-in chambers are sometimes used for heating or cooling. These chambers can house many containers, such as cardboard boxes filled with the items and, therefore, can heat or cool a large number of items simultaneously. However, the local velocity of the air in the large space within a walk-in chamber is very low; so it can take a long time to heat or cool the items, especially when they are enclosed in a container. In addition, the items must be transported from a storage site or a work station to the walk-in chamber and then returned to the storage site or work station after they are heated or cooled. Not only is this time consuming but during transportation, heated items may become cool or cooled items may become warm, thus negating the heating or cooling effects of the walk-in chamber. Further, for a single container or for a small number of items, a large walk-in chamber is both uneconomical and inefficient.

Smaller ovens or coolers are sometimes used to modify the temperature of the items. However, these devices typically have small doors to minimize heat transfer into or out of the device, and it is difficult to fit an entire container through the door and in the device. Therefore, the items are frequently unloaded from the container, loaded into the oven or cooler, heated or cooled, unloaded from the oven or cooler, and repacked in the container. Again, this is time consuming and risks negating the heating or cooling effected by the oven or cooler. In addition, the local velocity of the air in a typical oven or cooler can be fairly low; so again it takes a long time to heat or cool the items.

SUMMARY OF THE INVENTION

The present invention overcomes all of these disadvantages and provides temperature modification assemblies and methods which are not only efficient and economical but also highly portable and adaptable.

In accordance with one aspect of the invention, a temperature modification assembly comprises a housing, a temperature modification element, a blower, and at least one freely extending duct. The temperature modification element may be a heating element or a cooling element and is preferably disposed in the housing. The blower is arranged to direct a flow of air past the temperature modification element in order to heat or cool the air. The duct communicates with the blower and is coupled to the housing. In addition, the duct includes first and second closely-spaced surfaces defining a narrow pocket between them, and the first surface of the duct includes at least one opening. The duct further includes at least one vane disposed in the pocket to direct air through the opening.

In accordance with another aspect of the invention, a temperature modification assembly comprises a housing, a temperature modification element, a blower, at least one freely extending duct, and a controller. The temperature modification element may be a heating element or a cooling element and is preferably disposed in the housing. The blower is arranged to direct a flow of air past the temperature modification element in order to heat or cool the air. The duct is coupled to the housing and communicates with the blower. In addition, the duct includes first and second closely spaced surfaces defining a pocket having a narrow profile, and the first surface of the duct has at least one opening. The controller is coupled to the blower and arranged to recurrently reverse the direction of the air flow. Consequently, air alternatively flows through the duct in one direction from the temperature modification element through the pocket and out the opening and in the opposite direction from the opening through the pocket to the temperature modification element.

Temperature modification assemblies embodying these aspects of the invention are ideal for heating or cooling items in a container, e.g. for heating plastic conveyor modules packed in a cardboard box. Preferred embodiments of the temperature modification assembly are lightweight and portable, so they may be easily situated at the storage site or work station where the container is located. The container is simply opened and the freely extending, narrow duct is inserted into the container, preferably without removing any of the items from the container. For example, the freely extending narrow duct may be wedged between one wall of the container and the items in the container, with the opening in the first surface of the duct facing the items. The blower then forces air at high velocity past the temperature modification element, where the air is heated or cooled, and along the duct, through the opening in the duct, and among the items in the container. Because a high velocity heated or cooled air passes directly among the items in the container, the items are heated or cooled very quickly and efficiently. Once the items are heated or cooled, the duct is simply removed from the container. The heated or cooled items may be removed from the container immediately or the container may be closed, which helps to maintain the modified temperature of the items enclosed in the container.

In accordance with another aspect of the invention, a temperature modification assembly comprises a housing, a temperature modification element, first and second freely extending ducts, and a blower. Again, the temperature modification element may be a heating element or a cooling element and is preferably disposed in the housing. Each duct is coupled to the housing and includes at least one opening. The blower is arranged to direct a flow of air past the temperature modification element and to circulate the air flow from the housing between the first and second ducts and back to the housing.

In accordance with another aspect of the invention, a temperature modification assembly comprises a housing, a temperature modification element, first and second freely extending ducts, and a blower. The temperature modification element may be a heating element or a cooling element and is preferably disposed in the housing. The housing includes a flat base having first and second openings. The first and second freely extending ducts are coupled to the housing and respectively communicate with the first and second openings in the base of the housing. Each duct includes first and second closely spaced plates defining a pocket having a narrow profile, the first plate of the first duct faces the first plate of the second duct. The first plate of each duct is substantially flat and has a plurality of openings. The openings in the first plate of the first duct communicate with the pocket in the first duct which in turn communicates with the first opening in the base of the housing, while the openings in the first plate of the second duct communicate with the pocket in the second duct which in turn communicates with the second opening in the base of the housing. The blower is arranged to direct a flow of air past the temperature modification element and to circulate the air flow from the housing between the first and second ducts and back to the housing.

Temperature modification assemblies embodying these aspects of the invention heat or cool one or more items very rapidly and effectively. For example, the items may be positioned between the first and second ducts with the openings in the duct facing the items. The blower then directs the air at high velocity past the temperature modification element, where the air is heated or cooled, and through the opening in one duct, among the items, and into the opening in the other duct. Because the items are positioned between the ducts, the flow of heated or cooled air is concentrated among the items and they are heated or cooled very efficiently. While temperature modification assemblies embodying these aspects of the invention are preferably used to heat or cool items in a container such as a cardboard box, they may also be used to heat or cool items which are not in a container.

In accordance with a further aspect of the invention, a temperature modification assembly comprises a housing, a temperature modification element, a jacket, a blower,and a controller. The temperature modification element is preferably disposed within the housing, and the jacket has an interior and an open end. The controller is coupled to the blower and is arranged to recurrently reverse the direction of air flow. The blower is arranged to circulate a flow of air past the temperature modification element and to circulate the air flow from the housing to the interior of the jacket and back to the housing.

Temperature modification assemblies embodying these aspects of the invention are very effective for heating or cooling items which are not in a container as well as items which are in a container. For example, loose items may be grouped on a surface, or an open container of the items may be set on the surface, and the open end of the jacket may be positioned over the group of items or the container and the jacket may then be lowered over the items or the container. The blower is arranged to direct a flow of air past the temperature modification element in order to heat or cool the air and then into the interior of the jacket and among the items. The jacket serves to confine the flow of air within the interior of the jacket and among the items, so the items are heated quickly and effectively.

Temperature modification assemblies embodying the present invention have a wide variety of applications. For example, they may be used to dry papers, to dry plastic pellets prior to injection molding, and to regenerate desiccants. However, they are particularly useful for heating plastic conveyor modules, especially plastic modules contained in a cardboard box, prior to cutting or otherwise working the plastic modules.

DETAILED DESCRIPTION OF EMBODIMENTS

As shown in FIGS. 1–5, a first temperature modification assembly 10 embodying the present invention generally comprises a housing 11 which defines an air flow path, a blower 12 which directs a flow of air along the air flow path, and a temperature modification element 13 which heats or cools the air. Air generally includes any gas suitable for heating or cooling the items, including ambient air. The temperature modification assembly 10 is preferably an integral, lightweight structure which is highly portable and may easily be positioned near a group of items to heat or cool them or coupled to a container of items to heat or cool the items in the container.

Figure 1:
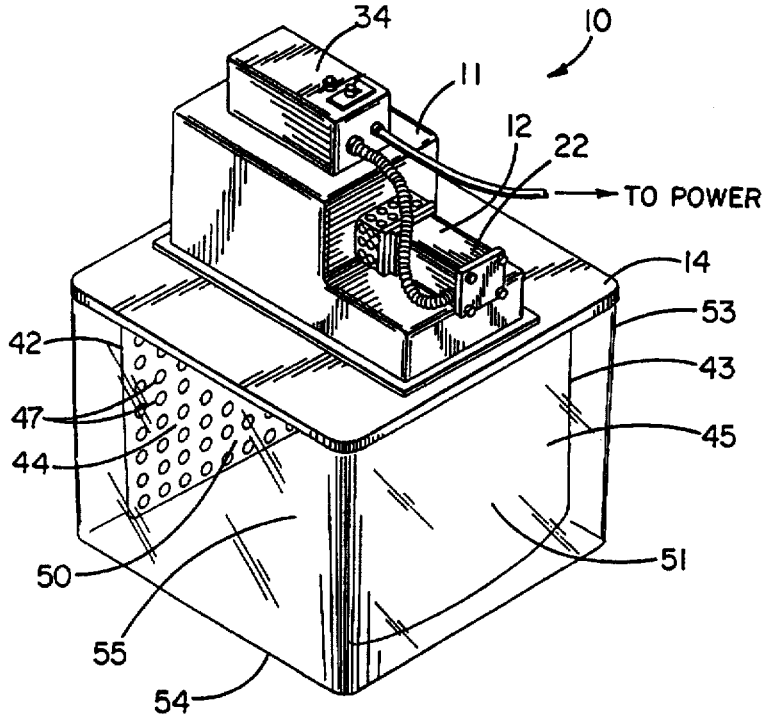
FIG. 1 is a perspective view of a first temperature modification assembly embodying the present invention.

The housing may be formed from any material suitable for the temperatures generated by the temperature modification element, including a metal or a plastic material. Preferably, the housing is formed from a lightweight, rugged material which facilitates lifting and maneuvering the temperature modification assembly 10. The housing may be variously configured. For example, it may have a cylindrical configuration or, as shown in FIG. 1, a generally boxy configuration. The housing preferably includes at least two openings. If the air is to be directed only once past the temperature modification element, the openings in the housing may be substantially isolated from each other, e.g., one opening being an ambient air inlet and the other opening being a heated or cooled air outlet. On the other hand, it may be more efficient and economical to circulate the air past the temperature modification element, so the openings may be arranged to communicate with each other. For example, in the temperature modification assembly 10 shown in FIGS. 2 and 3, the housing 11 includes a generally flat base 14 having first and second openings 15, 16 spaced from each other. The housing 11 defines a chamber 17 and the air is circulated along an air flow path through the chamber 17 inside the housing 11 and between the first and second openings 15, 16 outside the housing 11.

The blower may be operatively associated with the housing in any convenient manner to direct a flow of air across the temperature modification element. For example, it may be positioned entirely outside the housing and coupled to one of the openings in the housing to direct air into and along the air flow path within the housing. Alternatively, the blower may be positioned entirely inside the housing. In the temperature modification assembly 10 shown in FIGS. 1–3, the blower 11 includes a blade assembly 21 and an electric motor 22 coupled to the blade assembly 21. The blade assembly is positioned in the air flow path in the chamber 17 of the housing 11. However, the electric motor 22 is preferably isolated from the air flow path, more preferably by locating the electric motor 22 outside the housing, 11. Where the temperature modification element 13 is a heating element, locating the electric motor 22 outside the housing 11 best protects the electric motor 22 from the heat generated by the heating element. Where the temperature modification element 13 is a cooling element, locating the electric motor 22 outside the housing 11 isolates the heat load generated by the electric motor 22 from the cooling element.

The blower may be configured in a variety of ways. For example, the blade assembly may be a squirrel cage arrangement or a single stage fan blade arrangement. In the temperature modification assembly 10 shown in FIGS. 2 and 3, the blade assembly 21 is preferably a multi-stage assembly comprising, for example, three rotor blade stages 23 fixably mounted to a shaft 24. Between each rotor blade stage 23 is a stator blade arrangement 25, and the rotor blades and the stator blades are preferably oriented in different directions to better mix the air flowing through the blade assembly 21. Each stator blade arrangement 25 is attached to a cowl 26 which encloses the blade assembly 21 and is, in turn, attached to the housing 11. The cowl 26 has first and second ports 27, 28 which respectively communicate with the first and second openings 15, 16 in the housing 11. The housing chamber 17 is preferably arranged so the only air flow path through the chamber 17 between the first and second openings 15, 16 passes through the cowl 26. The shaft 24 is journaled to each stator blade arrangement 25 and extends axially along the cowl 26 through a seal 32 to the exterior of the housing 11, where it is connected to the electric motor 22 via a coupling covered by a guard 33.

The electric motor 22 is preferably a DC motor. For example, to produce a high velocity air flow, a DC motor rated 1/27 hp at 2,000–3,000 rpm is particularly suitable. The preferred electric motor 22 is also reversible because reversing the direction of air flow frequently allows the items to be more evenly heated or cooled. Alternatively, a non-reversible DC motor or a single or multi-phase AC motor may be used, or the motor may be mechanically, hydraulically, or pneumatically rather than electrically driven.

The temperature modification element may be any suitable element which heats or cools the air flowing past it, preferably to a temperature within a predetermined temperature range. For example, the temperature modification element may comprise a cooling element such as the cooling coil of a refrigeration system or a solid state cooling unit. Alternatively, the temperature modification element may be a heating element such as a burner assembly, the heating coil of a heating system, or a fixed resistance electrical heating element. In the temperature modification assembly 10 shown in FIG. 1, the temperature modification element 13 comprises a variable resistance heating element, preferably a self-limiting thermistor-type heater. For example, the heating element may be a 300 W thermistor-type heater having a temperature limit of about 200° F., such as that available under the trade designation Panasonic. A thermistor-type heater is also preferred because it is lightweight and self-contained, contributing to the portability of the temperature modification assembly 10. The temperature modification element 13 is preferably mounted to the housing 11 in the air flow path near the first port 15 of the blower 12.

Figure 5:
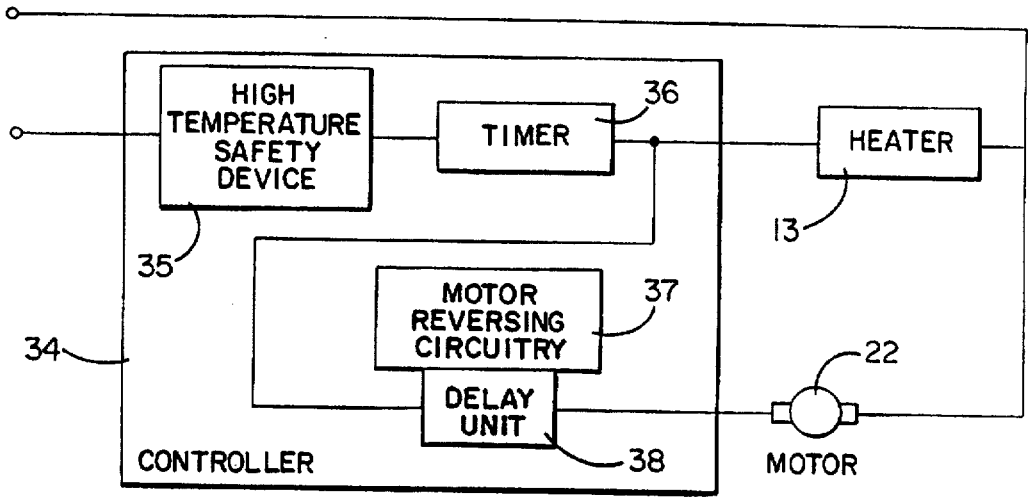
FIG. 5 is a block diagram of a controller for the temperature modification assembly of FIG. 1.

Although the temperature modification element and the blower may operate independently, they are preferably electrically coupled to a controller which supervises and coordinates their operation. The controller may be variously configured, for example, using relay circuitry, logic arrays, or a microprocessor, and the controller may be designed to perform any of a wide variety of functions. For example, the controller 34 of the first temperature modification assembly 10 includes a high temperature safety device 35, a timer 36, motor reversal circuitry 37 and a delay unit 38, as shown in FIG. 5. The high temperature safety device 35 serves as a redundant safety device which disconnects the blower motor 22 and the thermistor heater 13 from the power supply if the temperature-limiting heater 13 overheats. In other embodiments, a thermostat or other temperature control device may be coupled only to the temperature modification element, controlling the temperature modification element so the air flowing past it is maintained at a temperature within a predetermined temperature range.

The timer 36 serves to disconnect the blower motor 22 and the heater 13 from the power supply after a predetermined period of time has elapsed. The timer is preferably a variable input device, and it allows the items to be automatically heated or cooled for various predetermined periods of time, depending on the nature and quantity of the items.

The motor reversing circuitry 37 and the delay unit 38 serve to recurrently reverse the direction in which the blade assembly 21 is driven by reversing the electrical connection to the motor 22. This allows the air to be circulated by the temperature modification assembly first in one direction through the first and second openings in the housing and then in the opposite direction and, thereby, more evenly heats the items. The motor reversing circuitry 37 may include a timing mechanism which reverses the electrical connection to the motor at regular intervals, e.g., intervals of up to three minutes or more. Again, the motor reversing circuitry 37 may have a variable input allowing the reversals to occur at various predetermined intervals, depending on the nature and quantity of the items. The delay unit 38 disconnects the motor 22 from the power supply for a predetermined period of time, e.g., up to five seconds or more to allow the motor to slow or gradually stop, before the electrical connection to the motor 22 is reversed. This prevents damage to the mechanical coupling, e.g., due to abrupt changes in momentum, and damage to the electrical contacts, e.g., due to arcing.

In accordance with another aspect of the invention, the temperature modification assembly 10 further comprises one or more, preferably two, freely extending ducts 42, 43 coupled to the housing 11 as shown in FIGS. 1–4. The freely extending ducts are substantially free of supportive structure which would prevent them from being inserted into a container. In the first temperature modification assembly 10, the first and second ducts 42, 43 are identical and are immovably coupled to the housing 11 by rigidly connecting the first and second ducts 42, 43 to the base 14 at the first and second openings 15, 16 of the housing 11, respectively. The ducts may be rigidly connected in any suitable manner, including by means of a connector, a weld, or a bond. Preferably, the ducts are coupled to the housing by means of removable connectors, allowing ducts of varying widths and/or heights to be connected to the housing and inserted into containers of corresponding widths and/or heights. By providing a duct which has a width and a height corresponding to the width and height of the container, the air is more evenly distributed among the items in the container.

To facilitate insertion of the ducts into a container, each duct preferably comprises first and second closely-spaced surfaces defining between them a pocket having a narrow profile. The first surface includes at least one opening which communicates with the pocket. For example, in the first temperature modification assembly 10, the first and second surfaces 44, 45 are formed by front and rear plates 50, 51. Preferably, the rear plate 51 is solid and bows away from the front plate 50, while the front plate 50 is flat and includes the opening 47, preferably a plurality of evenly distributed openings 47, which communicate with the pocket 46. To further facilitate insertion of the ducts 42, 43 into a container, the pocket 46 may taper along its height so the duct 42, 43 has the shape of an elongate wedge. The front and rear plates 50, 51 may be connected to each other along three edges and to the base 14 of the housing at their fourth edges, connecting an opening 15, 16 in the housing 11 to the pocket 46 of a duct 42, 43. One or more vanes 52 may be attached to the front or rear plate 50, 51 and positioned within the pocket 46 to evenly distribute air flow from the housing opening 15, 16 along the width and/or height of the pocket 46 and through the duct openings 47. To facilitate circulation of air through the housing 11 and between the ducts 42, 43, the ducts 42, 43 may be arranged in opposition with the openings in the first surface 44 of one duct 42 facing the openings 47 in the first surface 44 of the other duct 43.

While the identical, opposing ducts 42, 43 of the first temperature modification assembly 10 are preferred, a temperature modification assembly embodying the present invention may have only a single duct or two or more different ducts. The ducts may be movably coupled to the housing, for example, via a flexible conduit or via a slide assembly that allows the ducts to slide along the housing and provide variable spacing between the ducts. Further, the ducts may be configured in many different ways. For example, the first and second surfaces may be formed from rigid coarse screens or a lattice of parallel ribs, and the ducts may have openings in both the first and second surfaces.

In accordance with another aspect of the invention, the temperature modification assembly 10 comprises a jacket 53. The jacket 53 includes an open end 54 so it can conveniently fit over a group of items or a container of the items. In addition, the jacket 53 is cooperatively arranged with the housing 11 so the blower 12 can circulate a flow of air between the temperature modification element 13 and the interior 55 of the jacket 53. The jacket serves to confine the flow of air which heats or cools the items. The jacket may be the primary confinement when the items are heated or cooled without a container or it may be a secondary confinement when the items are heated or cooled inside a container.

The jacket may be formed from a variety of materials. For example, the jacket may be formed from a rigid or pliable material, and it may include a thermal insulator, especially where the jacket is used as the primary confinement. Where the jacket is intended to support the weight of the remainder of the temperature modification assembly, it should be formed from a material with sufficient structural integrity. In addition, the jacket preferably includes a transparent portion which enables a user to observe the items and/or the container when the temperature modification assembly is being maneuvered into position.

The jacket may be cooperatively arranged with the housing in any suitable manner and it may be variously configured. For example, the jacket may be attached to the housing with the interior of the jacket communicating with at least one of the openings in the housing; the jacket may be an independent structure and the housing may rest on the jacket with the openings in the housing communicating with the interior of the jacket; or the housing may be coupled to the jacket, for example, via flexible conduits which communicate between the openings in the housing and the interior of the jacket. The jacket may be a pliable drape which has an irregular shape or a rigid cylinder or parallelepiped having solid walls. Further, the temperature modification assembly may be configured with the jacket and without the ducts, with the ducts and without the jacket, or with the jacket and the ducts, the ducts extending into the interior of the jacket and the jacket surrounding the ducts.

In the temperature modification assembly 10 shown in FIGS. 1–4, the jacket 53 comprises a skirt which is formed from a transparent polymeric material such as a Plexiglas® material and is generally configured as a parallelepiped having solid side walls and opposite open ends. The base 14 of the housing 11 is attached to and seals one of the open ends of the jacket 53, leaving the opposite end 54 open. The jacket 53 surrounds the ducts 42, 43, and the openings 15, 16 in the housing 11 communicate with the interior 55 of the jacket 53 via the ducts 42, 43. The jacket 53 is preferably spaced laterally from the ducts 42, 43 a distance sufficient to allow a container to fit between the ducts 42, 43 and the jacket 53. The jacket 53 supports the weight of the temperature modification assembly 10 and preferably extends below the ducts 42, 43 a distance sufficient to allow the ducts to extend to or near the bottom of the container when the jacket 53 is positioned around the container.

The present invention provides several methods for heating or cooling one or more items and these methods may be illustrated with respect to heating plastic conveyor modules. However, the invention is not limited to heating plastic conveyor modules but encompasses the heating or cooling of many different kinds of items.

Figure 2:
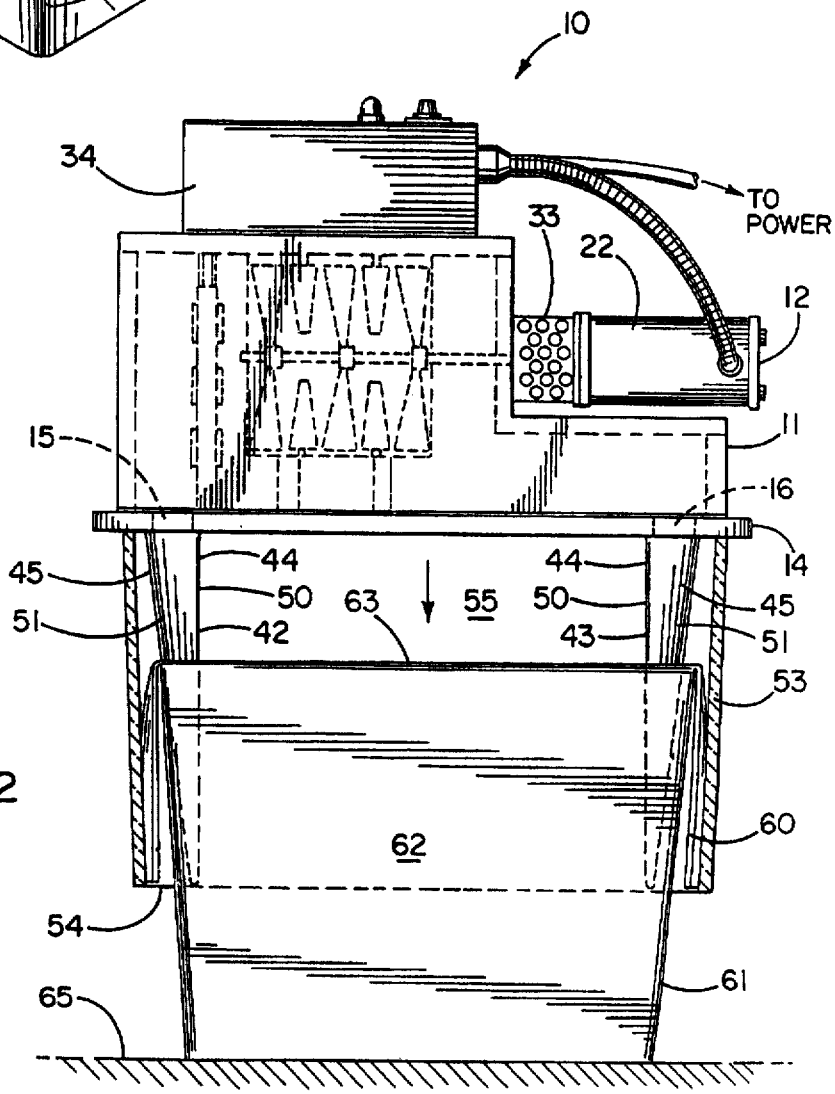
FIG. 2 is a side elevation view of the temperature modification assembly of FIG. 1 as it is being mounted to a container.
Figure 3:
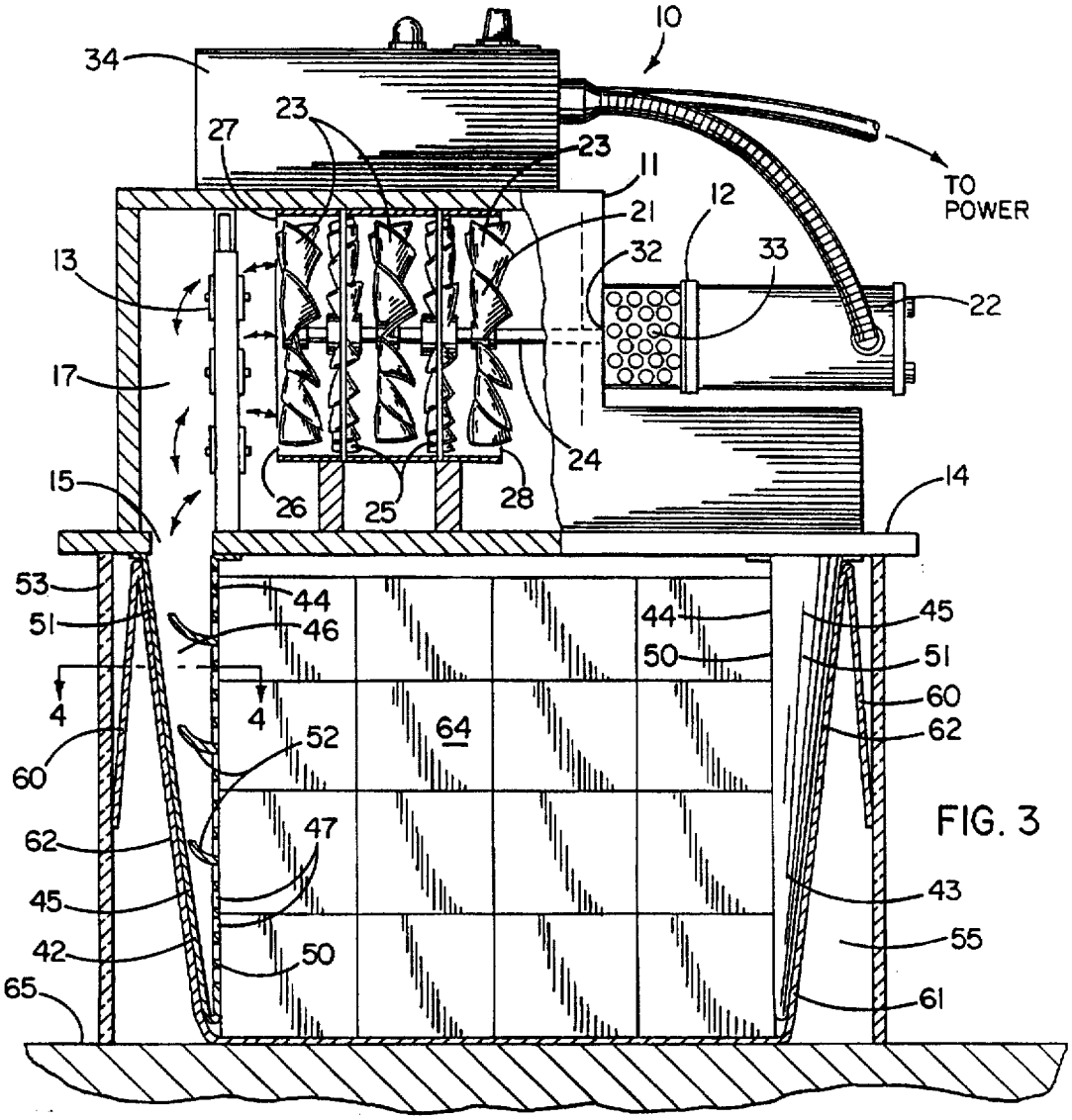
FIG. 3 is a partially sectioned elevation view of the temperature modification assembly of FIG. 1 fully mounted to a container.
Figure 4:
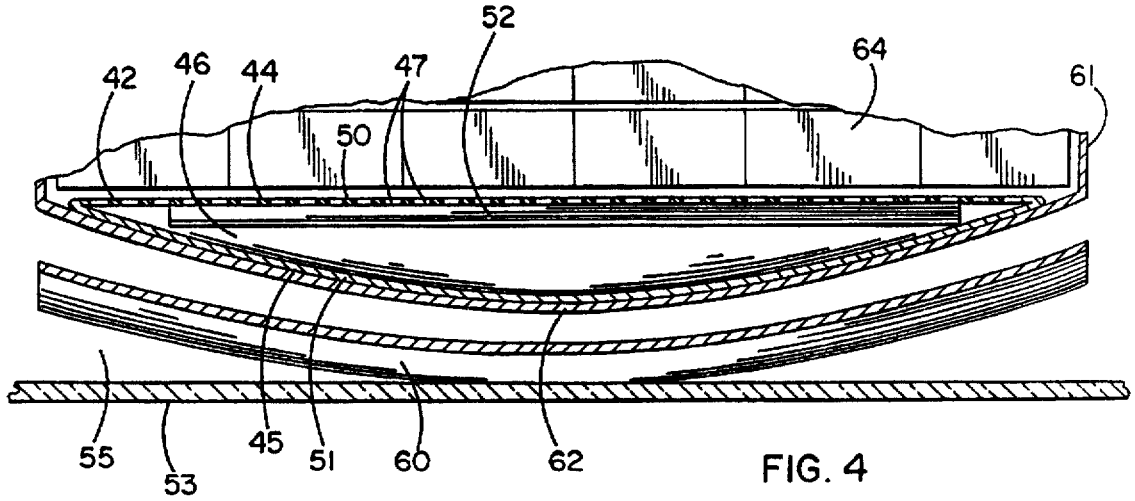
FIG. 4 is sectional plan view of a duct of the temperature modification assembly of FIG. 3.

In accordance with another aspect of the invention, the temperature of one or more plastic conveyor modules in a cardboard box may be modified by first providing an opening in the box. For example, as shown in FIGS. 2 and 3, the flaps 60 at the top of the box 61 may be separated and folded back along the side walls 62 of the box 61 so the entire top of the box 61 comprises the opening 63. Alternatively, the opening may be provided by cutting two parallel slits along opposite top edges of the box, each extending from one side to the opposite side of the box.

The temperature modification assembly is then physically coupled to the opening in the box. As shown in FIGS. 2 and 3 the temperature modification assembly 10 may be lifted and positioned over the opening 63 in the box 61. The temperature modification assembly 10 is then lowered onto the box 61, inserting the ducts 42, 43 in the opening 63 in the box 61, or through the slits in the box, and inserting the box 61 through the open end 54 of the jacket 53 and into the interior 55 of the jacket 53 between the jacket 53 and the ducts 42, 43. The distance between the ducts 43, 43 is preferably selected so that each duct 42, 43 is wedged between a sidewall 62 of the box 61 and the plastic conveyor modules 64 stacked in the box 61. The narrow, tapered ducts 42, 43 are well suited for wedging them into the box 61. The opposing flat front plates 50 of the ducts 42, 43 maintain the plastic modules 64 neatly stacked between the ducts 42, 43, and the inherent flexibility of the cardboard box 61 allows the side walls 62 of the box 61 to bow outwardly to accommodate the bowed rear plates 51 of the ducts 42, 43. The dimensions of the flat base 14 of the housing 11 and the height of the jacket 53 and ducts 42, 43 are preferably selected so that the base 14 comes to rest on the top of the box 61 as the open end 54 of the jacket 53 comes to rest near, and preferably on, the surface 65 on which the cardboard box 61 sits. The base 14 of the housing 11 then seals the opening 63 in the box 61 and confines the heated air within the box 61, while the jacket 53 supports the weight of the temperature modification assembly 10 and provides a secondary confinement around the cardboard box 61. Alternatively, the ducts may support the weight of the temperature modification assembly.

Although in the preferred embodiment two ducts and a jacket are inserted in and around the cardboard box, the temperature modification assembly may be coupled to the opening in the box in many other ways. For example, if the cardboard box can support the relatively light weight of the temperature modification assembly, the jacket and/or one or both of the ducts may be omitted. Coupling the opening in the box to the temperature modification assembly may then simply comprise sitting the flat base of the housing 11 on top of the opening in the box with at least one of the openings in the housing communicating via the opening in the box with the plastic conveyor modules.

Once the temperature modification assembly is coupled to the opening in the box, a flow of air having a temperature within a predetermined temperature range is directed between the temperature modification assembly and the plastic conveyor modules in the cardboard box. For example, air heated by the heater 13 to a temperature in the range from about 100° F. to about 150° F., e.g., about 120° F., is circulated by the blower 12 at a rate in the range from about 30 scfm to about 80 scfm, e.g., 50 scfm, between the temperature modification assembly 10 and the plastic conveyor modules 64 in the cardboard box 61. To heat the plastic modules enough to facilitate cutting them, the heated air may be circulated among the plastic conveyor modules for up to 15 minutes or more.

For example, the blower 22 may force air in the housing chamber 17 at high velocity from the first blower port 27 past the heater 13, where it is heated, and then through the first opening 15 in the housing 11. Heated air then flows through the opening 63 in the box 61 into the pocket 46 of the first duct 42, where it is evenly distributed through the openings 47 along the width and height of the first duct 42 by the vanes 52 in the pocket 46. From the first duct 42 the high velocity, heated air passes among the plastic conveyor modules 64 in the cardboard box 61, heating the plastic conveyor modules 64. The heated air is confined within the box 61 by the flat base 14 of the housing 11, which seals the opening 63 in the box 61. Because the air is confined within the box 61 and is passing at high velocity directly among the plastic modules 64, the plastic modules heat very quickly and efficiently. Any heated air which leaks from the box 61 is confined by the jacket 53, which not only protects the user from the heated air but also prevents the user from inadvertently touching the cardboard box 61, which is also being heated by the heated air. The jacket 53 also protects the user from the heated ducts 42, 43 when the temperature modification assembly 10 is removed from the box 61. From the plastic conveyor modules 64, the air flows through the openings 47 in the second duct 43, upward along the pocket 46 of the second duct 43, through the opening 63 in the box 61, and into the second opening 16 in the housing 11. From the second housing opening 16 the air returns through the housing chamber 17 to the second blower port 28, where the blower 22 continues to circulate the air from the temperature modification assembly 10 among the plastic conveyor modules 64 in the cardboard box 61 and back again.

To more evenly heat the plastic conveyor modules, the direction of circulation is recurrently reversed. For example, the controller 34 reverses the direction of rotation of the blade assembly 21 of the blower 12, thereby reversing the direction of circulation, at predetermined intervals of less than about ten minutes, preferably at intervals of about three minutes. Consequently, the direction of circulation changes every three minutes from one in which the air flows from the first port 27 of the blower 12 past the heater 13 through the first duct 42, from the first duct 42 to the second duct 43, and from the second duct 43 to the second port 28 of the blower 12 to one in which the air flows from the second port 28 of the blower 12 through the second duct 43, from the second duct 43 to the first duct 42, and from the first duct 42 past the heater 13 to the first port 27 of the blower 12.

Although in the preferred embodiment the blower circulates the air, the air may be directed between the temperature modification assembly and the items in the container in many other ways. For example, the air may be directed in a single pass through the container. In particular, the blower could draw ambient air through an ambient air inlet and then force the ambient air past the heater. The heated air could then be forced through the opening in the housing and the opening in the container and among the items in the container. The air may then be vented to the ambient environment either directly in the box or via a second opening and a vent in the housing. In cooling items that are much warmer than the ambient air temperature, it may be more efficient to draw in ambient air, cool it as it passes through a cooling element, force it past the items, and then vent it, rather than to recirculate the air warmed by the items through the cooling element.

Once the plastic conveyor modules 64 have been sufficiently heated, the temperature modification assembly 10 is simply lifted off the box 61. The plastic modules 64 may then be immediately removed from the box 61 and placed in a cutting apparatus. Or the flaps on the box 61 may be closed over the openings 63 and the plastic modules 64 may be cut later, the closed cardboard box 61 serving to insulate the heated modules 64.

In accordance with another aspect of the invention, the temperature of one or more items may be modified by positioning the open end of a jacket on a surface with the items disposed within the jacket. For example, if the stack of plastic conveyor modules 64 shown in FIG. 3 were not contained in a box but were stacked directly on the surface 65, the temperature modification assembly 10 may be lifted over and lowered onto the stack of modules 64. With the stack of modules 64 positioned between the first and second ducts 42, 43, the ducts move downwardly along the stack until the jacket 53 comes to rest near, and preferably on, the surface 65 on which the plastic conveyor modules 64 are stacked.

Although in the preferred embodiment, the entire temperature modification assembly including the first and second ducts is lowered over the stack of modules, the jacket may be positioned on the surface in other ways. For example, in alternative embodiments with only one or none of the ducts, the open end of the jacket may be lowered over the stack of modules without the ducts being adjacent to the stack. In other embodiments, the jacket may be detached from the base of the housing. The first open end of the detached jacket may be placed on the surface and the plastic conveyor modules may be stacked inside the jacket through the opposite second open end. The base of the housing may then be set upon the second open end of the jacket.

Once the open end of the jacket is positioned on the surface with its plastic conveyor modules inside the jacket, a flow of air having a temperature within a predetermined temperature range is directed within the jacket and among the plastic conveyor modules. For example, air heated by the heater 13 may be circulated by the blower 12 between the temperature modification assembly 10 and the plastic conveyor modules 64, as previously described, except the jacket 53 serves as the primary confinement. Circulation of the air through the ducts 42, 43, especially where the openings 47 in the ducts 42, 43 face each other, allows the high velocity air flow to be concentrated on the plastic conveyor modules stacked between the ducts 42,43. Consequently, the modules are heated quickly and efficiently. However, in alternative embodiments without the ducts, the air may be blown directly from one of the openings in the housing into the interior of the jacket and among the plastic conveyor modules.

Again, once the plastic conveyor modules 64 are sufficiently heated, the temperature modification assembly 10 is simply lifted off the box 61. The heated modules 64 may then be immediately removed from the box 61 or stored within the box 61 for later use.

Figure 6:
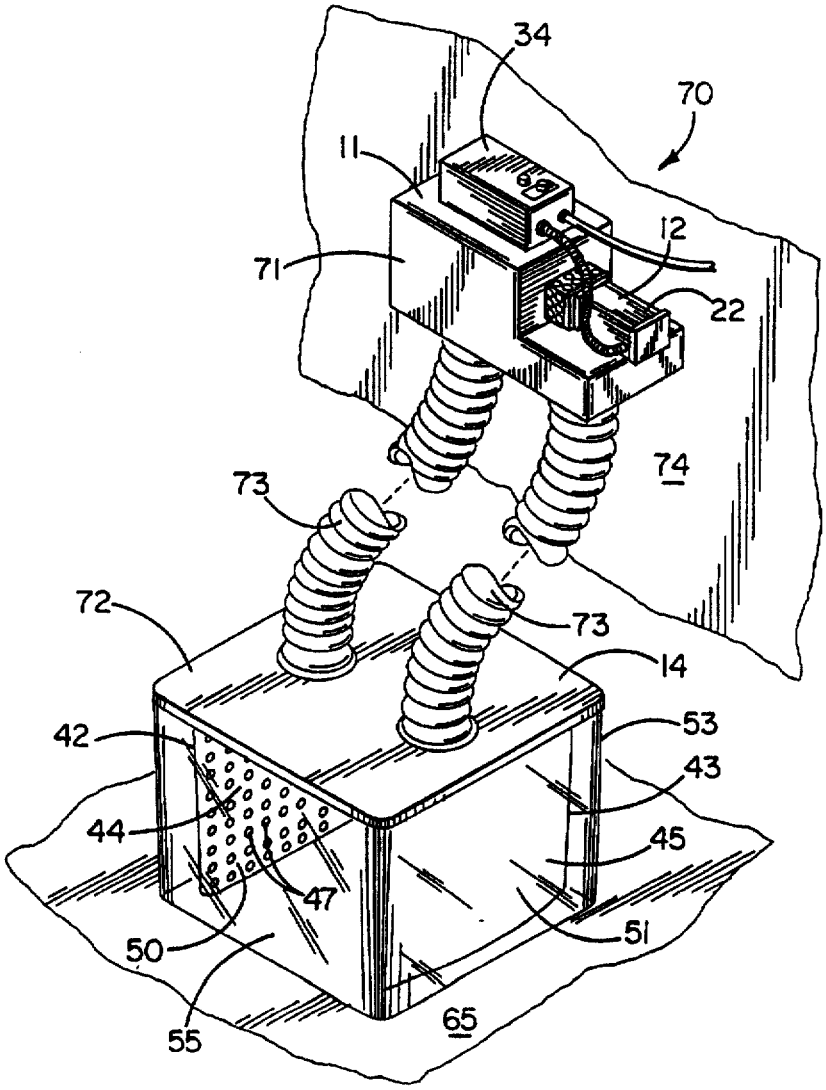
FIG. 6 is a perspective view of a second temperature modification assembly embodying the invention.

The first temperature modification assembly 10 shown in FIGS. 1–4 is preferably an integral, lightweight unit which can be lifted and maneuvered as a single structure. However, the invention encompasses temperature modification assemblies which are not integral structures. For example, as shown in FIG. 6, a second temperature modification assembly 70 comprises two principal units 71, 72. The first unit 71 includes a housing 11, a blower 12, and a temperature modification element which are very similar to those of the first temperature modification assembly 10. The second unit 72 includes a jacket 53, first and second ducts 42, 43, and a base 14 which are also very similar to those of the first temperature modification assembly 10. However, the first and second units 71, 72 are not integrally attached but are coupled through flexible conduits 73. This allows the first unit 71 to be mounted, for example, to a wall 74 while the second unit 72 rests on a surface 65, such as the surface 65 shown in FIG. 3. The ducts 42, 43 are coupled to the housing 11 and communicate with the blower 22 via the flexible conduits 73. The enclosed bottom of the housing 11 of the first unit 71 has first and second openings which respectively communicate with first and second openings 75, 76 in the base 14 of the second unit 72 via the flexible conduits 73. The first and second openings 75, 76 in the base 14 may respectively communicate directly with the pockets 46 of the first and second ducts 42, 43 and hence with the interior 55 of the jacket 53. In alternative embodiments without the ducts, the jacket may be cooperatively arranged with the housing through the flexible conduits, for example, so the openings in the base communicate directly with the interior of the jacket.

The second temperature modification assembly 70 operates virtually identically to the first temperature modification assembly 10, except the air travels between the housing 11 and the ducts 42, 43 and/or the jacket 53 via the flexible conduits 73. In addition, the second temperature modification assembly 70 is subject to the same variations in structure and operation as the first temperature modification assembly 10. However, the second temperature modification assembly 70 has the principal advantage that the second unit 72, which does not include the housing 11, the blower 12, or the temperature modification element, is even lighter than the lightweight first temperature modification assembly 10. Consequently, the second unit 72 may be lifted and maneuvered even more easily than the first temperature modification assembly 10.

Figure 7:
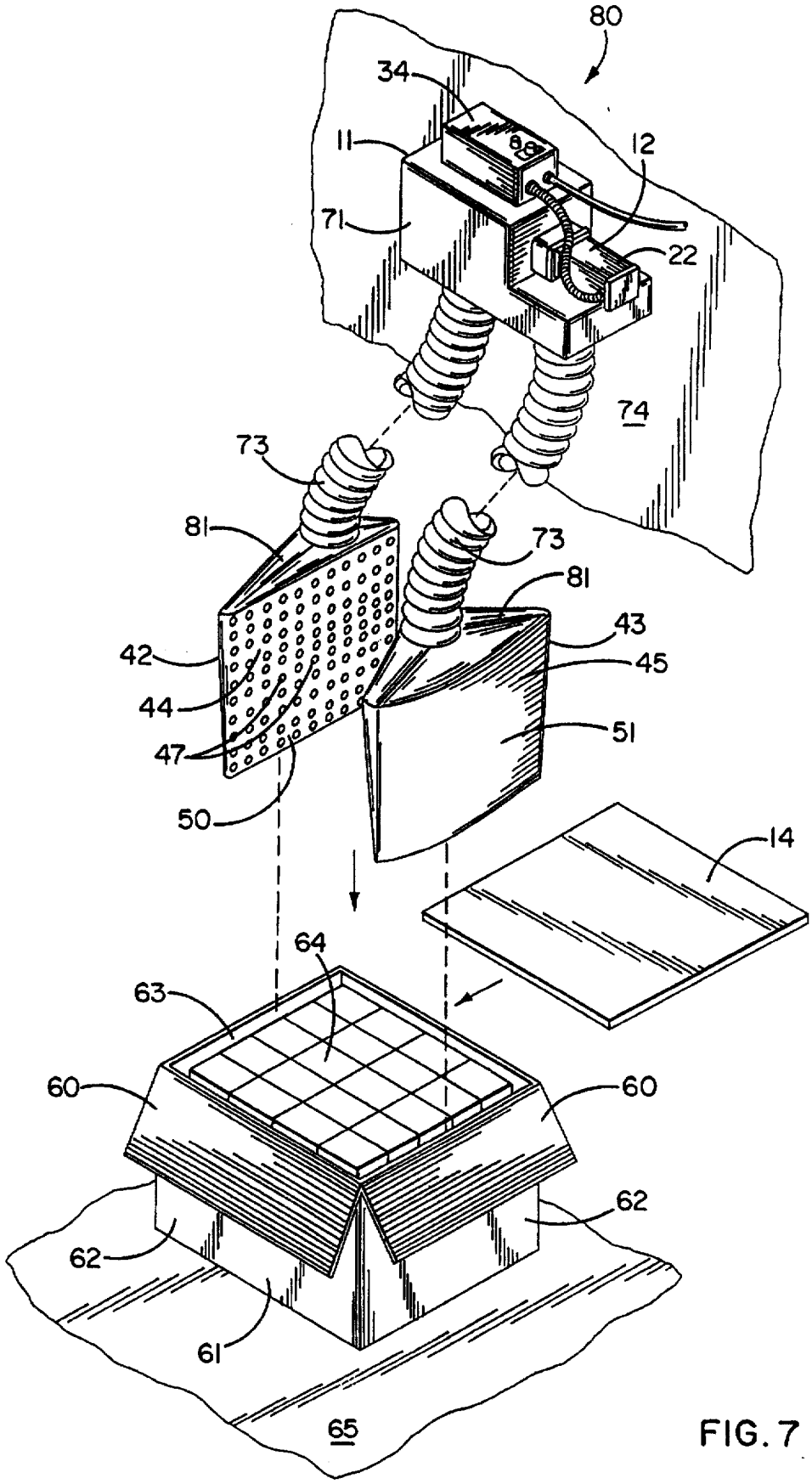
FIG. 7 is perspective view of a third temperature modification assembly embodying the invention.

A third temperature modification assembly 80 shown in FIG. 7 is even more adaptable than either the first or second temperature modification assemblies 10, 70. The third temperature modification assembly 80 includes a first unit 71 mounted to a wall 74 and flexible conduits 73 coupled at one end to the first unit 71, all similar to those of the second temperature modification assembly 70. However, the opposite ends of the flexible conduits 73 are connected to individual ducts 42, 43, the ducts 42, 43 being coupled to the housing 11 and communicating with the blower 22 via the flexible conduits 73. The first and second ducts 42, 43 of the third temperature modification assembly 80 are similar to those of the first temperature modification assembly 10. However, the first and second ducts 42, 43 of the third temperature modification assembly 80 each include a cover 81 which is connected to the flexible conduit 73 and channels air between the flexible conduit 73 and the pocket of the duct 42, 43. Further, while the ducts 42, 43 are each connected to a flexible conduit 73, they are preferably connected to no other structure. Consequently, the third temperature modification assembly 80 may be used with a wide variety of containers because the distance between the ducts 42, 43 is entirely variable, limited only by the length of the flexible conduits 73.

In a preferred method of operation, an opening 63 is provided in a container, such as a cardboard box 61, and the temperature modification assembly is then physically coupled to the opening in the box. For example, the ducts 42, 43 are inserted into the opening 63 in the box 61, e.g., and wedged between opposite side walls 62 of the box 61 and the plastic conveyor module 64 contained in the box 61, as previously described. Once the ducts, 42, 43 are inserted, a base 14 may be mounted over the top of the top of the box 61 between the ducts 42, 43, substantially sealing the opening 63 in the box 61. A jacket (not shown) may also be mounted around the container.

A flow of air having a temperature within a predetermined temperature range may then be directed between the temperature modification assembly and the plastic conveyor modules 64 in the cardboard box 61. For example, the blower 22 may circulate heated air at high velocity from the housing chamber along the flexible conduit 73 to the first duct 42, through the container 61 and among the plastic conveyor modules 64 to the second duct 43, and from the second duct 43 through the flexible conduit 73 back to the housing chamber, in a manner similar to that previously described.

While the invention has been described in terms of several embodiments, it is not limited to those embodiments. Rather, the invention encompasses all modifications, equivalents, and alternatives which are within the spirit and scope of the following claims.

We claim:

1. A temperature modification assembly comprising:

a housing;

a temperature modification element;

a blower arranged to direct an air flow past the temperature modification element; and at least one freely extending duct coupled to the housing and communicating with the blower, the duct including first and second spaced surfaces defining a pocket having a narrow profile, the first surface having at least one opening, wherein the duct includes at least one vane disposed in the pocket to direct air through the opening.

2. The temperature modification assembly of claim 1 wherein the first surface is substantially flat.

3. The temperature modification assembly of claim 2 wherein the second surface bows away from the first surface.

4. The temperature modification assembly of claim 1 wherein the housing includes a flat base, wherein the first and second surfaces respectively comprise first and second plates attached to the base of the housing, the first plate being substantially flat and having a plurality of evenly distributed openings communicating with the pocket, and wherein the duct further includes a plurality of vanes arranged at different heights within the pocket to direct air through the openings.

5. A temperature modification assembly comprising:

a housing;

a temperature modification element;

first and second freely extending ducts coupled to the housing, each duct including first and second spaced surfaces defining a pocket having a narrow profile, the first surfaces of the ducts facing each other and each first surface having at least one opening; and a blower arranged to direct a flow of air past the temperature modification element and to circulate the air flow from the housing between the first and second ducts and back to the housing.

6. The temperature modification assembly of claim 5 further comprising a controller coupled to the blower and arranged to recurrently reverse the direction of air flow.

7. The temperature modification assembly of claim 6 further comprising blower and arranged to recurrently reverse the direction of air a delay unit coupled to the controller and arranged to provide a delay between air flow reversals.

8. A temperature modification assembly comprising:

a housing;

a temperature modification element;

a jacket cooperatively arranged with the housing and having an interior and an open end, whereby the open end of the jacket can be positioned over one or more items and the jacket can be lowered over the one or more items;

a blower arranged to direct a flow of air past the temperature modification element and to circulate the air flow from the housing to the interior of the jacket and back to the housing; and a controller coupled to the blower and arranged to recurrently reverse the direction of the air flow.

9. The temperature modification assembly of claim 8 wherein the jacket includes a second end opposite the open end and wherein the housing is mounted to the second end of the jacket.

10. The temperature modification assembly of claim 8 wherein at least a portion of the jacket is transparent.

11. The temperature modification assembly of claim 8 further comprising first and second ducts communicating with the housing and extending into the interior of the jacket, each duct having an opening which opens into the interior of the jacket.

12. The temperature modification assembly of claim 1 wherein the pocket tapers along the height of the pocket.

13. The temperature modification assembly of claim 1 wherein the duct is immovably connected to the housing.

14. The temperature modification assembly of claim 1 wherein the duct is movably connected to the housing.

15. The temperature modification assembly of claim 8 wherein the housing includes a flat base and wherein the jacket comprises a skirt formed from a polymeric material and depending from the base of the housing.

16. The temperature modification assembly of claim 8 wherein the jacket comprises a thermal insulation.

17. The temperature modification assembly of claim 8 further comprising at least one duct which communicates with the housing and extends into the jacket, the duct having an opening which opens into the interior of the jacket.

18. The temperature modification assembly of claim 11 wherein the controller includes a delay unit arranged to provide a delay between air flow reversals.

19. The temperature modification assembly of claim 4 further comprising a controller coupled to the blower and arranged to recurrently reverse the direction of air flow, the controller including a delay unit arranged to provide a delay between air flow reversals.

20. The temperature modification assembly of claim 19 wherein the temperature modification element comprises a variable resistance heating element including a self-limiting thermistor-type heater disposed in the housing and wherein the blower comprises a cowl and a plurality of blades disposed in the cowl and oriented to mix air flowing through the cowl.

21. A temperature modification assembly comprising:

a housing including a flat base having first and second openings;

a temperature modification element;

first and second freely extending ducts coupled to the housing and respectively communicating with the first and second openings in the base of the housing, each duct including first and second spaced plates defining a pocket having a narrow profile, the first plate of each duct being substantially flat and having a plurality of openings, wherein the first plate of the first duct faces the first plate of the second duct and wherein the openings in each first plate communicate with the pocket which in turn communicates with the opening in the base of the housing; and a blower arranged to direct a flow of air past the temperature modification element and to circulate the air flow from the housing between the first and second ducts and back to the housing.

22. The temperature modification assembly of claim 21 wherein the blower is arranged to circulate air between the housing and the duct and the temperature modification assembly further comprises a controller coupled to the blower and arranged to recurrently reverse the direction of air flow, the controller including a delay unit arranged to provide a delay between air flow reversals.

23. The temperature modification assembly of claim 22 further comprising a jacket mounted to the base of the housing and having an interior and an open end, the first and second ducts extending into the interior of the jacket.

24. The temperature modification assembly of claim 11 wherein the housing includes a base having first and second openings and the first and second ducts respectively communicate with the first and second openings in the base of the housing and wherein the controller includes a delay unit arranged to provide a delay between air flow reversals.

25. The temperature modification assembly of claim 1 further comprising a controller coupled to the blower and arranged to recurrently reverse the direction of the air flow.

26. A temperature modification assembly comprising:

a housing;

a temperature modification element;

a blower arranged to direct an air flow past the temperature modification element;

at least one freely extending duct coupled to the housing and communicating with the blower, the duct including first and second spaced surfaces defining a pocket having a narrow profile, the first surface having at least one opening; and a controller coupled to the blower and arranged to recurrently reverse the direction of the air flow, whereby air alternately flows through the duct in one direction from the temperature modification element through the pocket and out the opening and in the opposite direction from the opening through the pocket to the temperature modification element.

27. The temperature modification assembly of claim 26 further comprising a delay unit coupled to the controller and arranged to provide a delay between air flow reversals.

28. The temperature modification assembly of claim 26 wherein the temperature modification element comprises a variable resistance heating element including a self-limiting thermistor-type heater disposed in the housing and wherein the blower comprises a cowl and a plurality of blades disposed in the cowl and oriented mixed air flowing through the cowl.

29. The temperature modification assembly of claim 26 wherein the housing includes a flat base having a first opening and wherein the duct extends from the flat base and communicates with the first opening in the flat base of the housing.

* * * * *

UNITED STATES PATENT AND TRADEMARK OFFICE

CERTIFICATE OF CORRECTION

PATENT NO. : 5,666,742

DATED : September 16, 1997

INVENTOR(S) : Greve et al.

It is certified that error appears in the above-indentified patent and that said Letters Patent is hereby corrected as shown below:

Column 13, Line 24, delete --blower and arranged to recurrently reverse the direction of air--.

Signed and Sealed this

Twenty-fifth Day of November, 1997

*Attest:*

*Attesting Officer*

BRUCE LEHMAN

*Commissioner of Patents and Trademarks*